United States Patent [19]

Blatt et al.

[11] 4,193,731

[45] Mar. 18, 1980

[54] ADJUSTABLE SHUTTLE MOUNT FOR PRESSES

[75] Inventors: John A. Blatt, Grosse Pte. Woods; Gordon J. Fox, Mt. Clemens, both of Mich.

[73] Assignee: Leland Francis Blatt, Grosse Point Shores, Mich.

[21] Appl. No.: 919,820

[22] Filed: Jun. 28, 1978

[51] Int. Cl.[2] ..... B25J 9/00; B65G 47/90

[52] U.S. Cl. ..... 414/589; 414/226

[58] Field of Search ..... 414/589, 222, 225, 226, 414/749, 677, 753, 751, 750, 787; 74/29, 89.15; 308/3.5, 6 R; 105/29 R; 100/218; 92/140

[56] References Cited

U.S. PATENT DOCUMENTS

| | | | |
|---|---|---|---|
| 3,665,771 | 5/1972 | Blatt | 74/29 |
| 3,714,870 | 2/1973 | Blatt | 92/140 |
| 3,742,774 | 7/1973 | Blatt | 74/89.15 |
| 3,921,820 | 11/1975 | Crockett | 414/753 |
| 4,005,782 | 2/1977 | Crockett | 414/753 |
| 4,007,782 | 2/1977 | Nybo et al. | 414/589 |
| 4,037,730 | 7/1977 | Fetzer et al. | 414/589 |

*Primary Examiner*—Stephen G. Kunin

*Assistant Examiner*—Lawrence E. Williams

*Attorney, Agent, or Firm*—Cullen, Sloman, Cantor, Grauer, Scott, & Rutherford

[57] ABSTRACT

A horizontally adjustable shuttle mount includes a main frame mountable upon a column of a press which has a bed. The frame includes a pair of horizontal vertically spaced tubes of square cross section with the upper tube having a pair of top walls inclined at 45 degrees to the vertical. The lower tube has an upright side wall. An upright carriage plate spans said tubes and is adapted to mount an automation unit for loading blanks and unloading formed panels from the bed of the press. A pair of 90-degree related cam roller followers are journalled upon opposite end portions of the carriage plate upon axes inclined at 45 degrees to the vertical and are supportably mounted upon the upper tube top walls. A pair of laterally spaced cam roller followers are journalled upon lower portions of the carriage plate and operatively engage the lower tube side wall. A power device on the frame is operatively connected to the carriage plate for longitudinally adjusting said plate along the frame for prelocating the automation unit with respect to the press bed.

7 Claims, 4 Drawing Figures

ADJUSTABLE SHUTTLE MOUNT FOR PRESSES

BACKGROUND OF THE INVENTION

Heretofore, in the use of power presses in the manufacture of automotive, truck and refrigerator panels and the like, there have been provided automation mechanisms which are adapted to be positioned with respect to the press bed for loading and unloading pressed panels therefrom. An example of such loading device is shown in the applicant's U.S. Pat. No. 3,714,870 entitled DUAL GRIP ACTUATING UNIT WITH TRAVEL CYLINDER ASSEMBLY.

For use in conjunction with such gripping devices, there have heretofore been provided mechanisms for effecting reciprocal feed movements of the gripping device so as to move the jaw assembly inwardly and outwardly with respect to the bed of the press for transporting the gripping device in different directions. Examples of such mechanisms are shown in applicant's U.S. Pat. No. 3,665,771 referred to as a STROKE MULTIPLYING RETRACTOR MECHANISM. Another example is shown in applicant's U.S. Pat. No. 3,742,774 entitled ADJUSTABLE STROKE RETRACTOR MECHANISM.

These devices may be generally referred to as an automation unit adapted for loading blanks and unloading formed panels from the bed of a press.

Heretofore, the problem has existed of providing an effective mechanism for properly positioning gripping devices and retractor mechanisms so that they may be out of the way during set up of the press with the proper dies and adjustment thereof but which may be transported accurately to the correct position and retained in that position so that the gripping mechanism moves reciprocally in a plane at right angles to the front face of the bed properly depositing the blank upon the die within the bed and for re-gripping the formed workpiece after action of the press so that the same may be withdrawn from the bed of the press.

SUMMARY OF THE INVENTION

It is an object of the present invention to provide a horizontally adjustable shuttle mount having a main frame which is adapted for mounting upon and transversely of the column of such press, and which includes an upright carriage plate whch is reciprocally mounted upon said frame and from which is supported and suspended an automation unit for loading blanks and unloading pressed panels from the bed of such press.

It is another object of the present invention to provide an improved frame construction by which the upright carriage plate is reciprocally supported and mounted upon said main frame and by which the carriage plate, once correctly adjusted with respect to the central axis of the die upon the press bed, may be locked in such position during reciprocal loading and unloading movements of the automation unit.

It is another object to provide an improved power mechanism for effecting longitudinal adjustments of the carriage plate and the suspended automation unit thereon and for effectively locking the automation unit in a preset adjusted position adapted for movements in a plane at right angles to the plane of feed movements of the automation unit supporting carriage plate.

These and other objects will be seen from the following specification and claims in conjection with the appended drawings.

DRAWINGS

Figure 1:
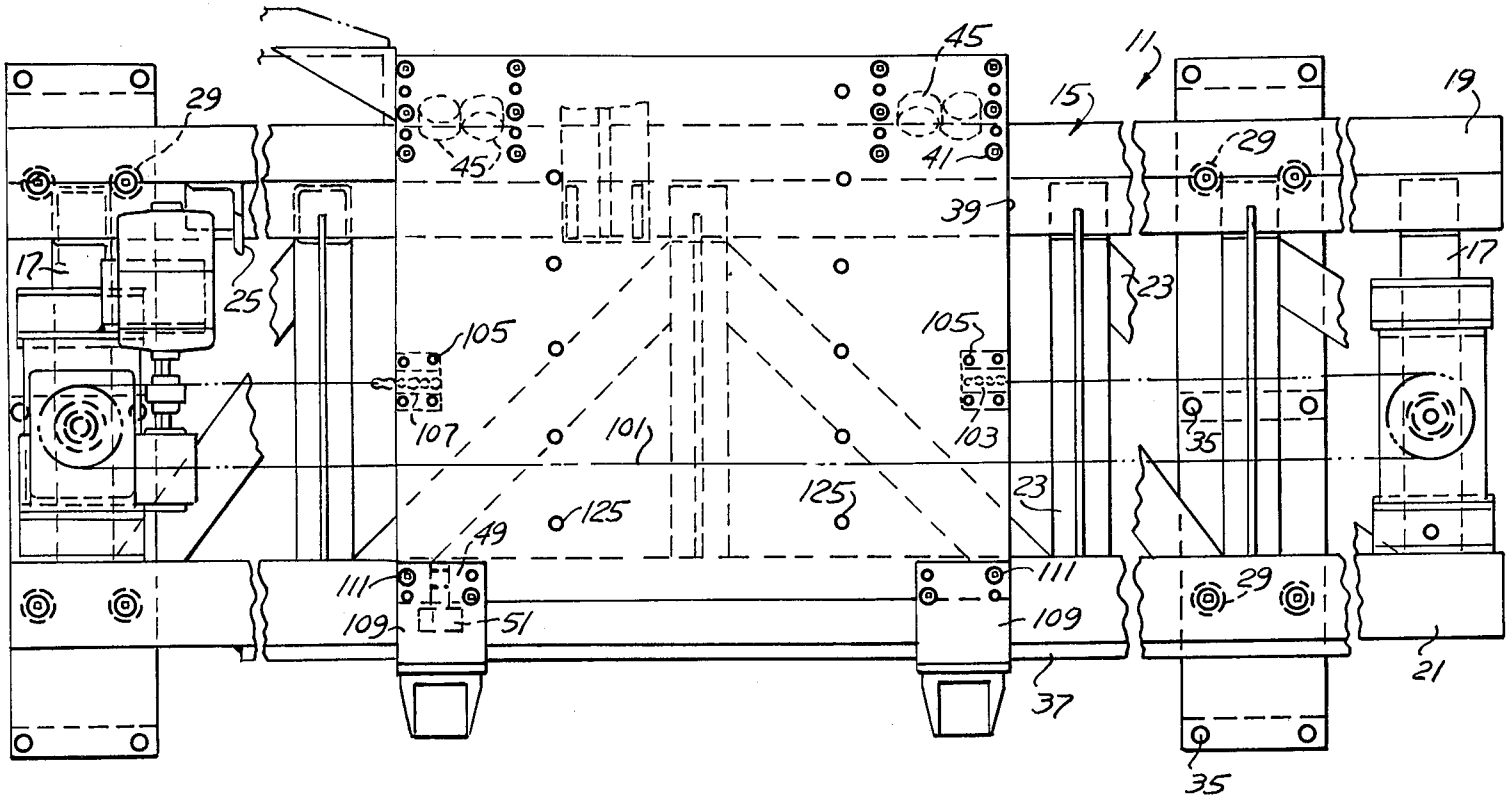
FIG. 1 is a fragmentary front elevational view of a horizontally adjustable shuttle mount as mounted upon a press fragmentarily shown.

It will be understood that the above drawings illustrate a preferred embodiment of the invention, and that other embodiments are contemplated within the scope of the claims hereafter set forth.

DETAILED DESCRIPTION OF THE INVENTION

Referring to the drawings, the press mounted horizontally adjustable shuttle mount is generally indicated at 11, as mounted upon the column 13 of a press, which has a conventional bed and which in the illustrated embodiment is used in the manufacture of automotive, truck or refrigerator panels and the like. In such conventional press construction, there is provided upon the bed, suitable dies secured within the press bed and upon the corresponding movable portions of the press such as to intermittently form within blanks fed into the press successively, a series of pressed panels. As is conventional and well-known steel or other metal blanks are applied one at a time to the press bed with respect to the dies therein and after formation suitable automation mechanism is employed to grip the formed panel and to withdraw it from the bed of the press. This is normally followed by the same automation equipment delivering a blank to the press bed for the next successive forming action and with a momentary retraction of the workpiece automation mechanism during the forming operation.

The present invention is primarily directed to a horizontally adjustable shuttle mount which is applied to the press column and which includes a main frame 15, FIG. 1. The main frame includes end supports 17 and between the end supports a pair of vertically spaced tubes of square cross-section shown at 19 and 21. The frame includes intermediate reenforcements as at 23 to complete a rigid main frame construction.

Stop plates 25 are secured to and project forwardly from end portions of the frame for positively limiting maximum slide movements of the carriage plate mounted upon said frame.

Figure 2:
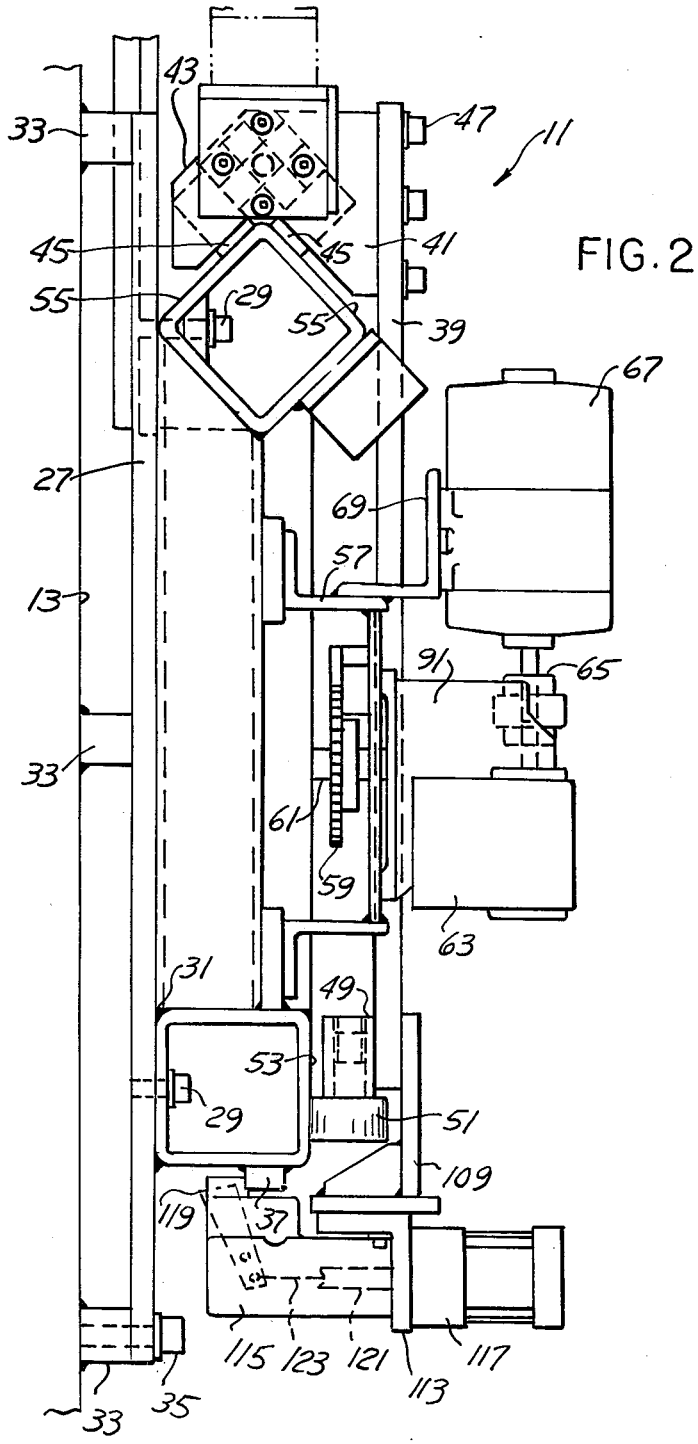
FIG. 2 is a left side elevational view thereof.
Figure 3:
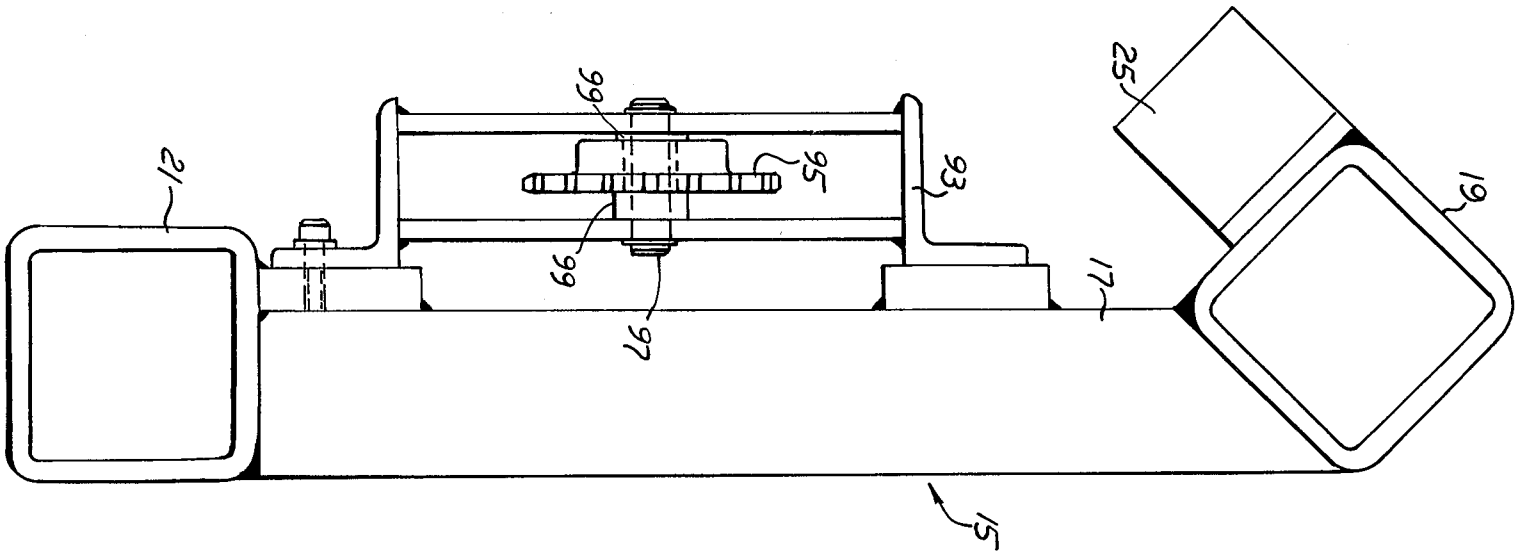
FIG. 3 is a right side elevatonal view thereof.

The main frame includes at ends thereof frame mount plates 27 which extend transversely of the column of the press and are suitably secured thereto over the mount bosses 33 FIG. 2, as by fasteners 35.

The respective square tubes 19 and 21 are additionally secured to frame mount plates 27 as by fasteners 29 and the welds 31.

The upper tube 19 includes a pair of top walls 55 which are inclined at 45° with the vertical. The lower tube 21, of square cross-section, includes an upright side wall 53.

The upright rectangular carriage plate 39 spans the tubes 19 and 21 and is movably mounted over said frame work and supported thereon.

A pair of longitudinally spaced bearing block mounts 41 are secured adjacent opposite ends of the carriage plate at the top thereof, each mounting a bearing block 43.

Each bearing block has mounted and journalled thereon a pair of 90° related cam follower rollers 45, which supportively bear upon and are movably mounted upon the upper tube top wall 55. The respective bearing block mount plates 41 are secured to the carriage plate as by the fasteners 47. Followers 45 are mounted on axes at 45° to the vertical.

An additional pair of longitudinally spaced bearing blocks 49 are mounted upon lower end portions of the carriage plate 39 and secured thereto. Each bearing block mounts a cam follower roller 51 journalled upon a vertical axis, adapted to operatively engage the lower tube side wall 53, FIG. 2.

As shown in FIGS. 1 and 2, drive sprocket mount 57 is affixed to the main frame and supportably journals the shaft 61 for drive sprocket 59.

Shaft 61 extends into and is connected to speed reducer 63 whose input is connected by coupling 65 to the output shaft of motor 67. The motor mount 69 supports said motor upon the main frame. Mount plate 91 supports the speed reducer 63 thereon.

At the opposite end of the main frame, FIG. 1, idler sprocket mount 93 is secured thereto for supporting the shaft 97 which journals idler sprocket 95, with suitable thrust washers 99 interposed.

Drive sprocket 59 and idler sprocket 95 are interconnected by the continuous sprocket chain 101 whose respective ends are anchored by chain tie-ins 103 and 107 to opposite sides of the carriage plate as by fasteners 105. This provides for longitudinal adjustments of said carriage plate upon the main frame.

A pair of longitudinally spaced clamp mounts 109 are secured by fasteners 111 to lower portions of the carriage plate 39. Brakcet 113 depends from each clamp mount and rigidly supports the transversely extending power clamp 115 which includes a power cylinder 117 and a reciprocal piston rod 121 fragmentarily shown. Each power clamp includes a pivotal clamp arm 119 and a suitable linkage 123 between the clamp arm and piston rod.

The respective clamp arms 119 are normally positioned spaced from carriage lock rod 37, and adapted upon activation of the respective power cylinders 117 for securing the carriage plate in a predetermined position along the frame and with respect to the press bed.

As shown in FIG. 1, there are upon carriage plate 39 a series of mounting holes 125 for securing the pair of upright support platde 129 upon which is mounted an automation unit 127 for loading blanks onto the press bed and for successively unloading pressed panels therefrom.

Figure 4:
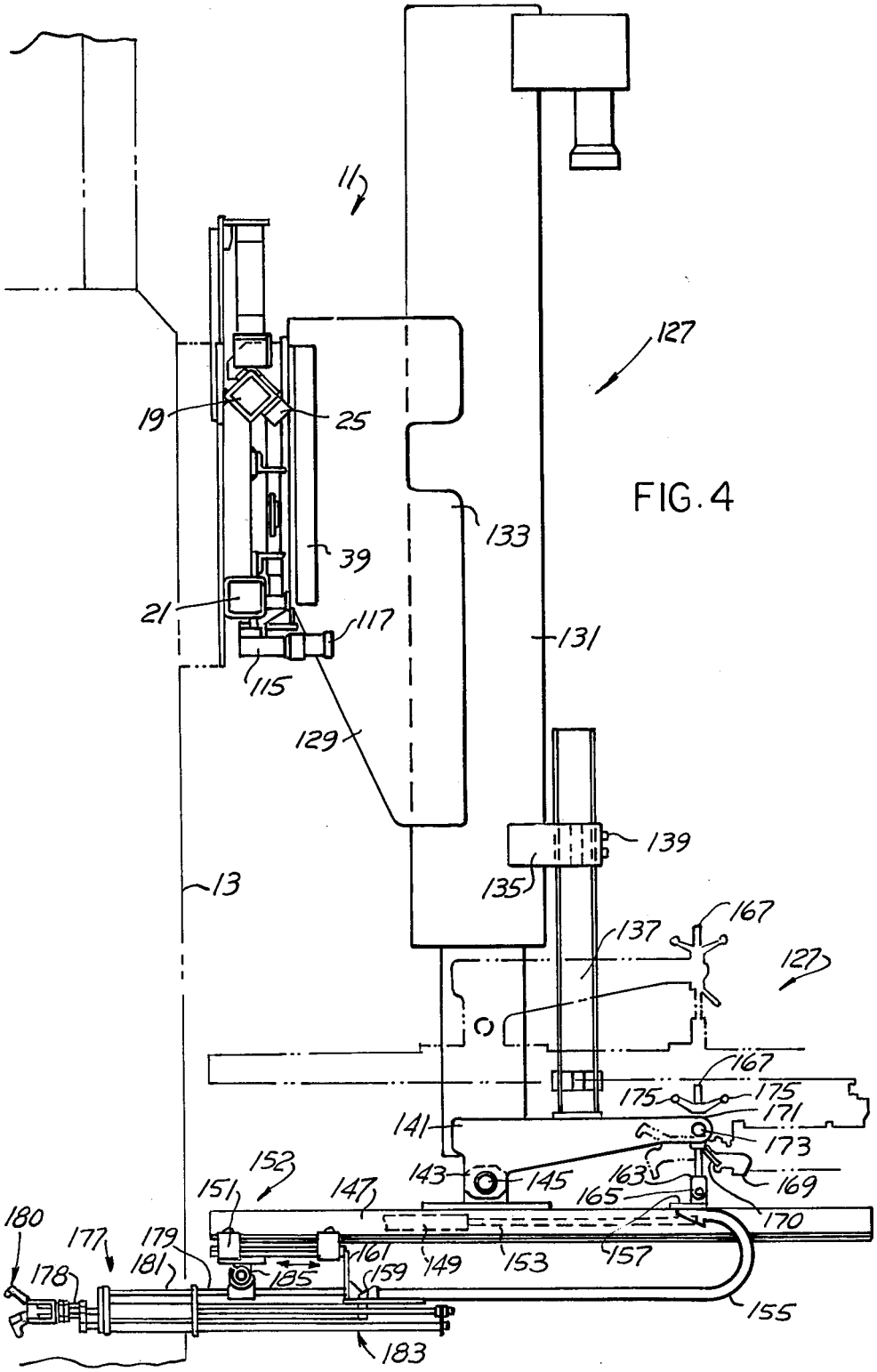
FIG. 4 is a fragmentary side elevational view thereof showing the mounting of the automation unit upon a shuttle mount carriage plate.

The mounting for the automation jaw unit 127, FIG. 4, includes an upright support 131 which is interposed between and secured to plates 129. Forwardly extending bracket 135 adjustably mounts as by fasteners 139 upright vertically adjustable support beam 137.

Trunion plate 141 is suitably affixed, as by welding to the lower end of support beam 137 and at one end has a depending pivot mount 143 supporting the trunion 145 which projects from and which supports in a generally horizontal position the elongated cylinder housing 147.

The elongated horizontally disposed cylinder housing 147 mounts an elongated power cylinder 149 which includes a reciprocal piston rod 153. A longitudinally reciprocal carriage 151 is slidably mounted upon side rail upon opposite sides of cylinder housing 147.

The aforesaid cylinder housing 147 with cylinder assembly 149, 153, and carriage 151 defines a multiple stroke retractor mechanism indicated at 152. Such a multiple stroke retractor mechanism is shown in detail in applicant's U.S. Pat. No. 3,665,771 as well as in applicant's U.S. Pat. No. 3,742,774 referred to as an adjustable stroke retractor mechanism.

Formed bracket 155 is connected at one end to an end portion of the piston rod 153, and at the opposite end of said bracket, is connected at 159 to carriage bracket plate 161 secured to carriage 151.

Accordingly, intermittent action of the power cylinder 149 and its piston rod 153 will cause intermittent longitudinal reciprocal movements of the carriage 151 from which depends the present automation unit loading and unloading device and power cylinder assembly 177.

A mechanism is incorporated into the support for the cylinder housing 147 for regulating the inclination thereof as horizontal or any other desired acute angle. This mechanism includes block 163, FIG. 4 pivotably mounted at 165 to a portion of the cylinder housing.

Threaded shaft 167 is anchored within block 163 and within an outer portion of the trunion plate 141, threaded through block 171 pivoted to trunion plate 141 at 173. Nut 169 has a control arm 170 thereon whereby with a hand lock 175 released, rotative adjustments of the nut 169 will cause raising or lowering of the trunion plate with respect to the pivot mounting 145 for thus regulating the inclination of the cylinder housing 147.

The present automation unit for loading blanks and unloading pressed panels from the bed of the press includes a jaw gripper assembly 177. The jaw gripper assembly includes the pair of pivotal jaws 180, shown open in FIG. 4 and including a power means or power cylinder 178 for controlling opening and closing of said jaws through a suitable linkage.

There is provided in the automation unit and for the support of the jaw assembly 180 a horizontally disposed support assembly generally indicated at 183. Said support assembly includes over the top thereof an elongated support rod 181 which is clamped to the pivot clamp 185 secured to the under surface of the carriage 151.

The detail of the construction and operation of the dual grip actuating unit with travel cylinder assembly is shown in applicant's U.S. Pat. No. 3,714,870 and further description as to details thereof is omitted herein.

Suffice it to say that present automation unit 127 which is suspended from the horizontally adjustable shuttle mount includes the jaw assembly with jaws 180 and with power mechanism at 178 for opening and closing the jaws. Associated therewith is the horizontally disposed support assembly 177 which is reciprocally movable in a plane at right angles to the plane of movement and the carriage plate 39 by virtue of the above described stroke multiplying retractor mechanism generally shown at 152, FIG. 4.

Accordingly, once the carriage has been longitudinally adjusted upon the frame as above described and has been locked in its adjusted position by the clamping mechanism 115, the automation unit 127 is, thus, effective for controlling transverse movements of the jaw assembly in a plane at right angles to the plane of movement of the carriage plate for the purpose of moving the jaws into and out of the area adjacent to the press bed.

One advantage of this construction is that utilizing the present shuttle mount, during the setup of the press, the automation unit may be adjusted upon the frame and by the shuttle mount so as to be out of the way during the setup. Thereafter the shuttle mount assembly and carriage plate may be so adjusted so that the automation unit is in the exact position with respect to the center line of the press bed or elsewhere so that the jaws when moved inwardly will transport a blank onto the bed of the press and on opening thereof will leave the blank within the press bed and the jaw assembly will retract. Thereafter the press operates to form the blank and after formation the jaw assembly is returned automatically and the jaws again grip the workpiece as pressed and retract transporting the pressed panel or the like workpiece from the bed of the press after the movable part of the press mechanism has been elevated. The next successive return movement of the jaw assembly 180 is such as to position a new blank upon the press bed; after which the jaws open and the jaw assembly retracts as a part of the automation mechanism to facilitate continued intermittent operation of the press mechanism.

There has been above described a power means on the frame and connected to the carriage plate for longitudinally adjusting said plate and for prelocating the automation unit. In the illustrated embodiment there has been a sprocket drive mechanism for moving the sprocket chain connected to the carriage plate. The drive mechanism may be electrically operated, air operated or manually powered for proper positioning of the carriage plate in a desired position. It is then locked in position by automatic powered clamps at the bottom of the carriage plate.

Having described our invention, reference should now be had to the following claims.

We claim:

1. A horizontally adjustable shuttle mount comprising a main frame adapted for mounting upon and transversely of the column of a press having a bed and used in the manufacture of automotive, truck or refrigerator panels;

said frame including a pair of horizontal, vertically spaced tubes of square cross section, the upper tube having a pair of top walls inclined at 45 degrees with the vertical;

the lower tube having an upright side wall;

an upright carriage plate spanning said tubes and adapted to mount an automation unit for loading blanks and unloading pressed panels from the bed of said press;

a pair of longitudinally spaced bearing blocks mounted adjacent the upper end of said carriage plate;

a pair of 90 degree related cam roller followers journalled upon each bearing block upon axes inclined at 45 degrees to the vertical supportably bearing upon said upper tube top walls;

a pair of longitudinally spaced bearing blocks mounted adjacent the lower end of said carriage plate;

a cam roller follower journalled upon each latter bearing block upon a vertical axis and operatively engaging said lower tube side wall;

and power means on said frame and connected to said carriage plate for longitudinally adjusting said plate along said frame for pre-locating said automation unit upon and with respect to the press bed.

2. In the shuttle mount of claim 1, said power means including a drive sprocket and spaced idler sprocket journalled upon horizontal axes adjacent opposite ends of said frame;

a sprocket chain extending around said sprockets with its ends secured to opposite sides of said carriage plate respectively;

and a power drive means mounted upon said frame at on end thereof and connected to said drive sprocket.

3. In the shuttle mount of claim 2, said power drive means including a motor mounted upon said main frame having an output shaft;

a speed reducer coupled with said motor output shaft and having an output shaft connected to said drive sprocket.

4. In the shuttle mount of claim 1, a pair of stop plates mounted adjacent ends of one of said frame tubes, in the path of reciprocal movements of said carriage plate for limiting maximum movements thereof.

5. In the shuttle mount of claim 1, a carriage lock rod underlying the lower frame tube and secured thereto along its length;

and a power clamp mounted on said carriage plate having a normally retracted clamp arm spaced from and movable along said lock rod;

said power clamp including a power means and a linkage interconnecting said power means and clamp arm for selectively moving said clamp arm into frictional locking engagement with said lock rod for securing said carriage plate in a predetermined position relative to said press.

6. In the shuttle mount of claim 1, said automation unit including a jaw assembly having a pair of jaws with power means to open and close the jaws;

a horizontally disposed support assembly mounting said jaw assembly and reciprocally movable in a plane at right angles to the plane of movement of said carriage plate;

and a horizontally disposed adjustable stroke rectractor mechanism mounting said support assembly and adjustably suspended from and mounted on said carriage plate.

7. In the shuttle mount of claim 6, said adjustable stroke retractor mechanism including an elongated cylinder housing having an exterior trackway;

a carriage movably mounted on said trackway and connected to said support assembly;

and a reciprocal piston rod and cylinder assembly within said cylinder housing, with said rod connected to said carriage.

* * * * *